United States Patent [19]

Van Guilder

[11] Patent Number: 4,829,629

[45] Date of Patent: May 16, 1989

[54] UNITARY AND STATIONARY DOOR STOP WITH MOVABLE STOP PORTION

[76] Inventor: Dean Van Guilder, 4301 Tara #8, Las Vegas, Nev. 89102

[21] Appl. No.: 137,934

[22] Filed: Dec. 28, 1987

[51] Int. Cl.[4] ..... E05F 5/02

[52] U.S. Cl. ..... 16/85; 16/86 A

[58] Field of Search ..... 16/82, 85, 86 R, 86 A, 16/86 B, 86 C; 292/DIG. 15

[56] References Cited

U.S. PATENT DOCUMENTS

| | | | |
|---|---|---|---|
| 1,090,307 | 3/1914 | Hoffman | 16/82 |
| 2,475,711 | 7/1949 | Meister | 16/86 A |
| 3,640,559 | 2/1972 | Royer | 16/82 |
| 4,044,424 | 8/1977 | Sasgen | 16/85 |
| 4,209,876 | 7/1980 | Wilzig et al. | 16/82 |

*Primary Examiner*—Fred A. Silverberg

*Attorney, Agent, or Firm*—Jerry R. Seiler

[57] ABSTRACT

A door stop device for limiting the maximum extent to which a hinged or pivoted door secured on a door jamb cam be opened comprises a unitary strip of memory retaining material having a base portion for being secured against said door, and a stop portion extending at an obtuse angle therefrom and away from said door for contacting said door jamb when said door is opened. opened.

17 Claims, 2 Drawing Sheets

UNITARY AND STATIONARY DOOR STOP WITH MOVABLE STOP PORTION

BACKGROUND OF THE INVENTION

Hinged or pivot-type doors, especially commercial-type doors or otherwise heavy doors using pneumatic or piston-type door closers present substantial maintenance problems as the door closers wearing out because of frequent use. When such door closers wear out, they do not stop the door from being opened past the 90°-100° maximum normal open position, whereby the door can become damaged as it contacts or slams against the door jamb. Similarly, glass doors in metal frames also present a similar problem in that substantial damage to the door closer, jamb, hinges and/or the door itself may be caused by the door being opened too far. It is to the elimination of such a problem that the present invention is directed.

SUMMARY OF THE INVENTION

The present invention comprises a device which may be secured on a wood or metal framed door and which device acts as a stop against the door jamb when attempted to be opened beyond a desired extent. The device may be placed at any suitable location on the door, preferably, near the bottom/or top inside corner of the door adjacent to the jamb. The specific components, features and functions of the device of the invention as well as its various embodiments will be explained in the following description.

DETAILED DESCRIPTION OF A PREFERRED EMBODIMENT

Figure 1:
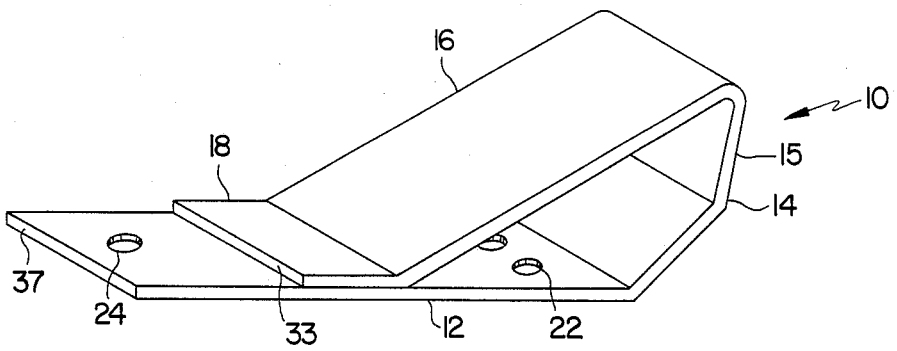
FIG. 1 is a perspective view of the main embodiment of the device of the invention.
Figure 2:
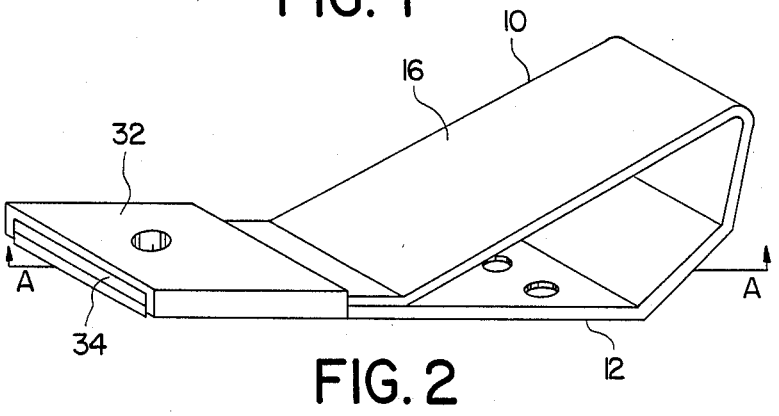
FIG. 2 is a perspective view of an assembly of the device including a cover plate and spacer.
Figure 3:
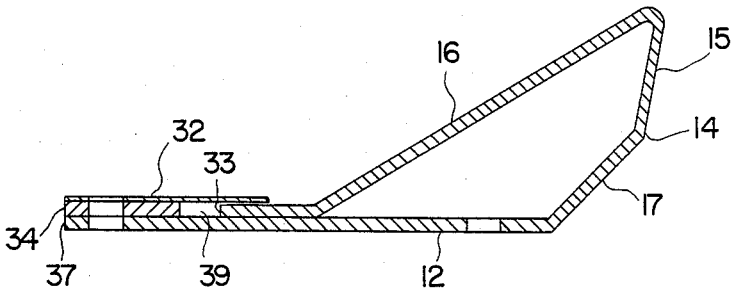
FIG. 3 is a side-sectional view of the assembly taken along line A—A of FIG. 2.

In the preferred embodiment of the invention illustrated in FIGS. 1-3, the main body 10 comprises a unitary strip of memory retaining material, preferably a spring steel or other ferrous material, although any other metals or alloys having memory or spring-like qualities may also be used. Alternatively, a number of plastic materials may be used, including nylon, high impact polystyrene, ABS polymers, and the like which are tough, resilient and memory retaining and that can be bolted or otherwise secured onto a wooden or metal frame door.

Figure 4:
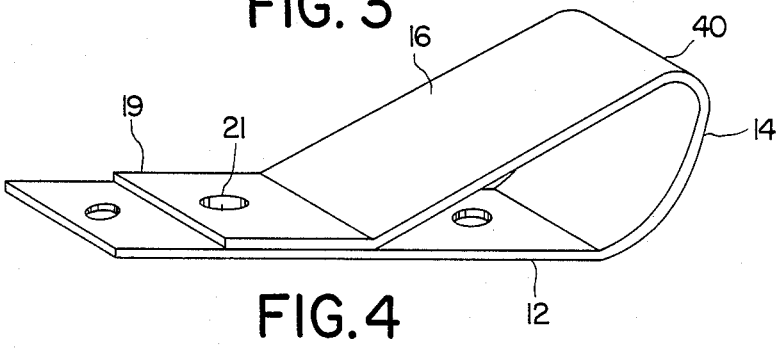
FIG. 4 is a perspective view of another embodiment of a main body of the device of the invention.

Preferably, the device is of a flattened steel stock as shown and incorporates a base portion 12, stop portion 14 and a return portion 16. The base portion is preferably elongated and substantially flat and planar and contains a plurality of holes or orifices 22 and 24 drilled or formed just large enough to accept a suitable bolt or screw. Preferably, bolts are used and may extend entirely through a door frame. Stop portion 14 extends at an obtuse angle from base portion 12 away from a door on which the device is mounted. In the most preferred embodiment, the stop portion includes two angled surfaces 15 and 17, angle surface 15 being an obtuse angle of at least 90° relative to the plane of elongated base member 12, and a second joining section 17 at greater obtuse angle than the angle of shoulder portion 15. Alternatively, shoulder portion 14 may be a single obtuse angle portion, or it may be even curved or arched as illustrated in FIG. 4. Return section 16 extends from stop portion 14 back toward base portion 12 at an acute angle relative to stop portion 14. At the end of the return portion is a substantially flat end portion 18 which terminates at an end 33 short of end 37 of base portion 12.

Although the main body 10 of the device of the invention may be itself secured to a door without further attachments or components, and operate to achieve the desired function, a preferred assembly is illustrated in FIGS. 2 and 3 incorporating additionally a cover 32 which is secured over ends 33 and 37 of the main body and which assembly further includes a spacer 34 set between the upper surface of base portion 12 and under cover 32 leaving a space 39 to accommodate reciprocal movement of end 33 of the device as it flexes or moves when shoulder 14 is urged against a door jamb.

Figure 5:
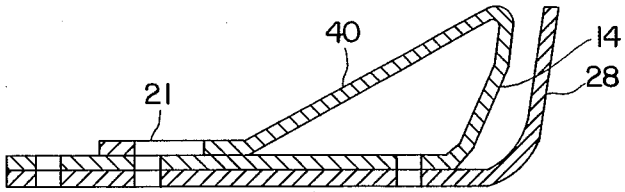
FIG. 5 is a side elevational view of yet another embodiment of the invention.

In FIG. 4, there is illustrated yet another embodiment including a rounded or arc-shaped shoulder 14, still extending generally at an obtuse angle away from base portion 12. In the embodiment shown, an elongated bolt slot 21 is provided for movement of shoulder 14, return portion 16 and end portion 19. Such an elongated slot 21 in end portion 19 allows for reciprocal movement of the upper part comprising the three components 14, 16 and 19 during use of the device. Although the device illustrated in FIG. 4 may be used alone for the intended purpose of preventing a door from being opened too far, a further embodiment is shown in FIG. 5 which includes an optional stop member 28 which actually performs the function of the shoulder 14 by itself contacting a door jamb and will be moved toward stop portion 14 of the device as illustrated when the door is opened.

Figure 6:
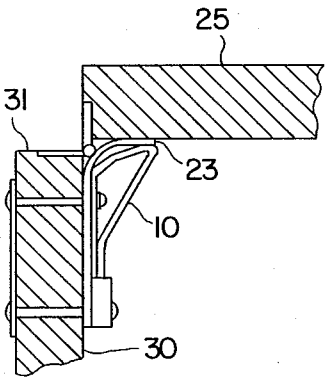
FIG. 6 is a view illustrating the device of the invention secured to a door adjacent a door jamb shown in section.
Figure 7:
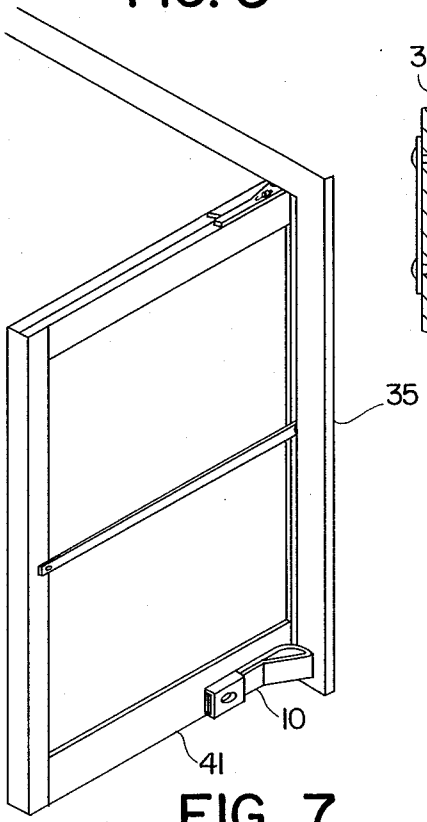
FIG. 7 is a perspective view of the device of the invention on a door of the pivot type.

In FIG. 6 there is shown the device of the invention 10 installed on a door 30 utilizing bolts extending through the door secured with nuts or other means of attachment. The door is hingedly secured to door jamb 25, with the door opened approximately 90° with the device 10 preventing substantial further opening of the door. It will be understood that the device may be installed along the door relative to the inside edge 31 to allow greater or lesser maximum opening of the door. In the installation illustrated in FIG. 6, there is also shown optional flexible plastic or composition plate 23 used between the door and the device 10 which prevents damage to the door and the frame. Such a plate is preferably of sufficient length to extend between the shoulder of the device and the door acting as a pad or buffer when the door is fully opened and gives further support to the installation. In FIG. 7 the device 10 is shown mounted along bottom edge 41 adjacent the inside edge of the door, the preferred location of installation. As shown, the door is a pivot-type in which pivot hardware is located on the floor and in the upper portion door jamb or frame 35, often used in commercial door installations. The device may also be mounted along the top edge of a door, or two devices may be used, at the top and bottom, where the door construction and heavy use dictate. These advantages as well as other modifications within the scope of the invention will be evident to those skilled in the art.

I claim:

1. A door stop device for limiting the maximum extent to which a hinged or pivoted door secured on a door jamb can be opened comprising:

a unitary strip of memory retaining material having a base portion having a longitudinal axis for being secured on said door in a stationary position relative to said door, and a movable stop portion extending at an obtuse angle therefrom and away from said door for contacting said door jamb when said door is opened, said stop portion terminating in a movable end, said stop portion and said movable end being free to move relative to and nonrotatably along said longitudinal axis of said base portion when stop portion is urged against said door jamb when said door is opened.

2. The device of claim 1 wherein said stop portion includes a shoulder extending from said base portion for contacting said door stop and a return portion extending from said shoulder to said movable end.

3. The device of claim 2 wherein said base portion includes a bottom surface for being secured against said door and an upper surface, and wherein said return portion substantially extends to said upper surface.

4. The device of claim 3 wherein said base portion is substantially flat and extends along a first plane.

5. The device of claim 4 wherein said return portion includes an end portion opposite said shoulder, said end portion being substantially flat and lying along a second plane substantially parallel with said first plane.

6. The device of claim 1 including means for securing said base portion to said door.

7. The device of claim 1 wherein said base portion includes a plurality of holes therethrough.

8. The device of claim 4 having a base portion end on said base portion opposite said stop portion and a cover member for being secured over both said movable end and said base portion end.

9. The device of claim 5 wherein said end portion overlies a portion of the upper surface of said base portion and, wherein said end portion is movable along said second plane.

10. The device of claim 4 wherein said return portion extends between said stop portion and said base portion along a third plane forming an obtuse angle with said first plane and extending from said stop portion at an acute angle.

11. The device of claim 1 wherein said shoulder includes a substantially flat shoulder section for contacting said door jamb said door is opened.

12. The device of claim 11 wherein said flat shoulder section extends along a fourth plane lying in said obtuse angle.

13. The device of claim 1 wherein said material is spring steel.

14. In combination a door hingedly or pivotally secured in a door jamb, and a device of claim 1 secured to said door adjacent the edge of said door secured to said jamb.

15. The combination of claim 14 wherein said device is secured adjacent the bottom edge of said door.

16. A door stop device for limiting the maximum extent to which a hinged or pivoted door secured on a door jamb can be opened comprising:

a unitary strip of memory retaining material having a base portion portion having a longitudinal axis for being immovably secured on said door in a stationary position relative to said door, a shoulder portion extending at an obtuse angle from said base portion and away from said door, and a return portion extending from said shoulder portion toward said base portion and terminating in a movable end, wherein said shoulder portion and said return portion are movable relative to and nonrotatably along said longitudinal axis of said base portion when said shoulder portion is urged against said door jamb when said door is opened.

17. A door stop apparatus for limiting the maximum extent to which a hinged or pivoted door secured on a door jamb can be opened comprising:

a first unitary strip of memory retaining material having a base portion having a longitudinal axis for being secured adjacent said door in a stationary position, and a movable stop portion extending at an obtuse angle from said base portion and away from said door and terminating in a movable end, whereby said stop portion and said movable end are free to move relative to and nonrotatably along said longitudinal axis of said base portion, and a second unitary strip of memory retaining material having a base portion for being secured in a stationary position to said door, between said base portion of said first unitary strip and said door, and a shoulder portion extending at an obtuse angle from said base portion and away from said door for contacting said door jamb then said door is opened, said shoulder portion being free to move relative to said base portion.

* * * * *